United States Patent [19]

Seifert

[11] Patent Number: 4,803,468

[45] Date of Patent: Feb. 7, 1989

[54] SECURITY FENCE WITH SECURITY WIRES FASTENED TO POSTS VIA SENSORS

[75] Inventor: Harald Seifert, Hofheim, Fed. Rep. of Germany

[73] Assignee: KTV Sicherheitstechnik GmbH, Amberg, Fed. Rep. of Germany

[21] Appl. No.: 71,808

[22] Filed: Jul. 10, 1987

[30] Foreign Application Priority Data

May 8, 1987 [DE] Fed. Rep. of Germany ..... 87106681

[51] Int. Cl.[4] ..... G08B 13/12

[52] U.S. Cl. ..... 340/566; 340/541

[58] Field of Search ..... 340/566, 564, 541, 550, 340/683

[56] References Cited

U.S. PATENT DOCUMENTS

| | | | |
|---|---|---|---|
| 3,803,548 | 4/1974 | Skujins, Jr. | 340/566 |
| 3,947,835 | 3/1976 | Laymon | 340/566 |
| 4,306,228 | 12/1981 | Meyer | 340/566 |
| 4,307,387 | 12/1981 | Baxendale | 340/566 |
| 4,365,239 | 12/1982 | Mongeon | 340/566 X |

*Primary Examiner*—Glen R. Swann, III

*Attorney, Agent, or Firm*—Pascal & Associates

[57] ABSTRACT

A security fence, in which contact sensors produce corresponding signals when the security wires are touched. Each sensor is attached to two low-pass filters, the cutoff frequency of one filter being above, and below the cutoff frequency of the other filter being below the frequency spectrum of a sensor signal which occurs when the wire is deflected by a person. The output signals of the low-pass filters are subtracted in a subtraction circuit. If the subtracted output signal of the subtraction circuit exceeds a predetermined threshold, an alarm signal is released. Deflections of the wire due to other circumstances and, therefore being in another frequency spectrum do not result in the alarm being released.

5 Claims, 1 Drawing Sheet

SECURITY FENCE WITH SECURITY WIRES FASTENED TO POSTS VIA SENSORS

The invention relates to a security fence of the type which uses security wires fastened to fence posts via sensors.

A fence of this type is described in German Patent No. 35 23 872. An evaluation circuit described therein is comprised of a switching system which connects the individual sensors in sequence to a measurement system. The measurement system measures, in sequence, the signal amplitudes of the sensors and forms a mean value from this. The signal amplitude of each sensor is compared to the mean value by means of a comparator and an alarm signal is released when the difference between the signal amplitude and mean value exceeds a threshold. The result, in this case, is that an alarm signal is released when there are slow movements of the security wires, as long as these slow movements occur only in one or a few security wires. On the other hand, an alarm signal is not released if such slow movements are caused by environmental influences, for example, by changes in temperature, which occur in a large number of security wires.

The disadvantage of this evaluation circuit is that it requires a large computing capacity when there are a large number of sensors, in order to form the mean value from the number of signal amplitudes.

It is the object of the present invention to provide a design of an evaluation circuit in which it is not necessary to collect a large number of signal amplitudes.

The invention is described below in greater detail with reference to the drawing, in which.

Figure 1:
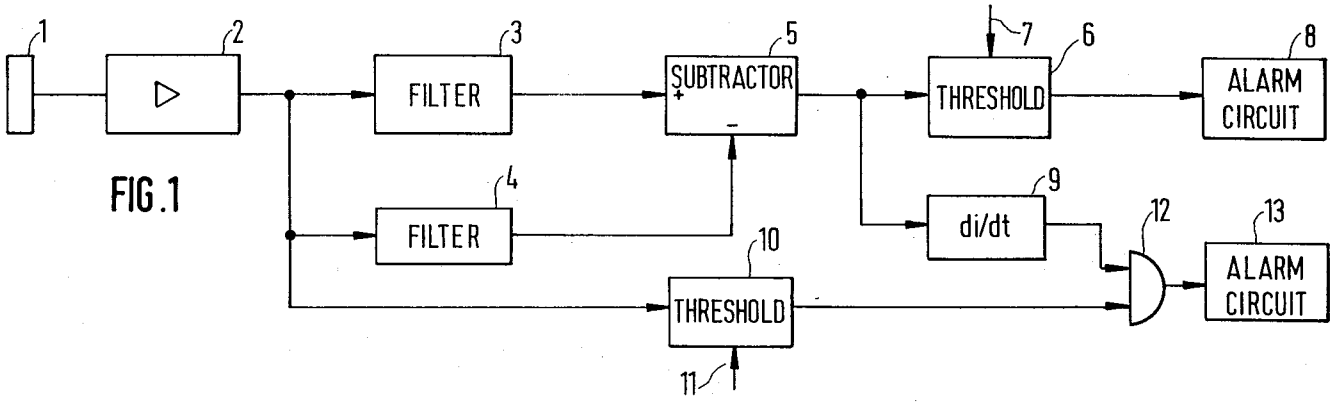
FIG. 1 is a block diagram illustrating a first embodiment of the invention.

As shown in FIG. 1, the signal of sensor 1 is passed via an amplifier 2 to the inputs of two parallel switched low-pass filters 3, 4. These two low-pass filters have different cutoff frequencies.

If a security wire is touched by a person and is thus deflected, then the sensor signal has a typical response which is within a characteristic frequency spectrum. This frequency spectrum differs from other frequency spectrums, which have signal patterns which are activated by other causes when the security wires are deflected. Other causes are, for example, fluctuations in temperature, gusty winds, falling twigs and branches. The frequency spectrums which result in this case are partially above and partially below the frequency spectrum which occurs when a security wire is deflected by a person.

In order to detect the frequency spectrum caused by a person, the cutoff frequency of the low-pass filter 3 is chosen such that it lies above the frequency spectrum of the sensor signal which results when the wire is deflected by a person. The low-pass filter 3, therefore, allows all the frequencies to pass through up to its cutoff frequency. On the other hand, the other low-pass filter 4 has a cutoff frequency which lies at the lower cutoff of the above-noted frequency spectrum. This means that this frequency spectrum is not allowed to pass through.

The outputs of the two low-pass filters 3, 4 are connected to a subtraction circuit 5, which provides the difference between the output signals of the two low-pass filters 3, 4. In this way, a signal occurs at the output of the subtraction circuit 5, which signal corresponds to the frequency spectrum of the sensor signal which results when a wire is deflected by a person. This signal is applied to the input of a threshold value circuit 6. If the output signal of the subtraction circuit 5 exceeds a predetermined threshold value 7, then an alarm is released. In this case, a signal from threshold valve circuit 6 is applied to a first alarm circuit 8.

It is, moreover, desirable to release a so-called technical alarm if, for example, a heavy branch hits a security wire and continues to hang there. In this case, it is necessary to remove the branch from the wire when the fence is being inspected. The signal which occurs in this instance changes very rapidly and has a large amplitude. It passes through the frequency spectrum of the sensor signal which occurs when a wire is deflected by a person.

In order to detect this, the output of the subtraction circuit 5 is connected to an impulse detector 9, i.e. comprising a differentiator, which provides the time differential of the output signal of the subtraction circuit. As a result, a quick signal change is detected. Moreover, the output of amplifier 2 is applied to a further threshold circuit 10. The outputs of the impulse detector 9 and the threshold circuit 10 are applied to respective inputs of AND gate 12. If the sensor signal exceeds a threshold value 11, then gate circuit 12 is enabled with an output signal of impulse detector 9. If the jump detector 9 produces an output signal corresponding to a quick change of the sensor signal and if this sensor signal lies above the threshold value 11, corresponding to a high signal amplitude, then the gate circuit 12 produces an alarm enable signal which is applied to a second alarm circuit 13. The circuit 13 can be designed in such a way that, during simultaneous enabling of both alarm circuits 8 and 13, an operation relay is suppressed in the first alarm circuit 8.

Figure 2:
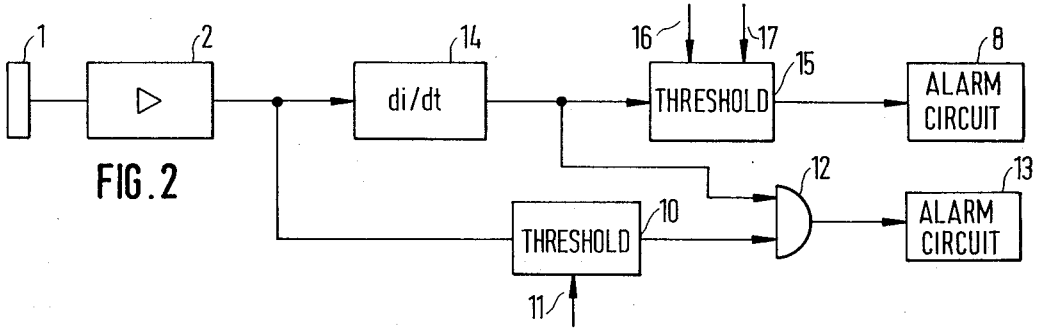
FIG. 2 is a block diagram illustrating a second embodiment of the invention.

In the second embodiment as shown in FIG. 2, the signal of sensor 1 is applied to a differentiator 14 via amplifier 2. This differentiator provides the time differential of the applied sensor signal. The output signal of the differentiator 14 is applied to a threshold circuit 15. There are two threshold values 16 and 17 at this threshold circuit 15. A lower threshold value 16 is at the lower cutoff of the time differential spectrum which occurs in the frequency spectrum of the sensor signal resulting when a wire is deflected by a person. An upper threshold value 17, on the other hand, is at the upper cutoff of the above-noted time differential spectrum. The threshold circuit 15 allows such signals to pass through which are within this time differential spectrum, and they are then applied to the first alarm circuit 8.

To release the above-noted technical alarm, the output of differentiator 14 is connected to an input of AND gate circuit 12 whose other input is connected to the output of threshold circuit 10, whose input, as in the embodiment of FIG. 1, is connected to the output of amplifier 2. The threshold value 11 is also applied to threshold circuit 10. The operation of this branch corresponds to that of the corresponding branch of the embodiment of FIG. 1.

I claim:

1. A security fence comprising wires fastened to posts via sensors, at least one electronic evaluation circuit connected to the sensors for releasing an alarm signal when one of the sensors signals a contact to the wire connected to it, each evaluation circuit being comprised of first and second low pass filters to which each sensor is connected, each filter having different cutoff frequencies, one cutoff frequency being above and the other cutoff frequency being below the frequency spectrum of a sensor signal which occurs when the wire is deflected by a person, a subtraction circuit being connected to the outputs of the low pass filters for providing the difference between the output signals of the low pass filters, a first threshold circuit for receiving the output signals of the subtraction circuit for applying the output signals above a predetermined amplitude to a first alarm circuit, a second threshold circuit for receiving signals from the sensors connected to the low pass filters and for passing sensor signals above a predetermined amplitude, an AND gate for receiving the sensor signals above a predetermined amplitude at one input, a differentiator for receiving the output signal of the subtraction circuit and for providing an output signal comprised of the time differential of the output signal of the subtraction circuit to a second input of the AND gate, and a second alarm circuit connected to the output of the AND gate and being enabled when a signal appears at both inputs of the AND gate.

2. A security fence as defined in claim 1 in which the first alarm circuit is deactivated by the second alarm circuit during simultaneous enabling of both alarm circuits.

3. A security fence comprising wires fastened to posts via sensors, and an electronic evaluation circuit connected to the sensors for releasing an alarm signal when one of the sensors signals a contact of the wire connected to it, the evaluation circuit being comprised of a differentiator connected to each sensor for providing an output signal comprised of the time differential of the sensor signal, a comparator for receiving the time differential of the sensor signal and for allowing output signals to pass through which occur in a frequency spectrum of the sensor signal which result when the wire is deflected by a person, and a first alarm circuit for receiving the output signals which pass through the comparator.

4. A security fence as defined in claim 3 further including an AND gate for receiving at one input the output signal of the differentiator, a further comparator for receiving the sensor signals, for allowing sensor signals above a predetermined amplitude to pass through, and for applying the latter signals to a further input of the AND gate, and a second alarm circuit connected to the output of the AND gate and being enabled when signals appear at both inputs of the gate circuit.

5. A security fence as claimed in claim 4, in which the first alarm circuit is deactivated by the second alarm circuit during simultaneous enabling of both alarm circuits.

* * * * *